US006839043B2

(12) United States Patent
Nakajima

(10) Patent No.: US 6,839,043 B2
(45) Date of Patent: Jan. 4, 2005

(54) ACTIVE MATRIX DISPLAY DEVICE AND MOBILE TERMINAL USING THE DEVICE

(75) Inventor: Yoshiharu Nakajima, Kanagawa (JP)

(73) Assignee: Sony Corporation (JP)

( * ) Notice: Subject to any disclaimer, the term of this patent is extended or adjusted under 35 U.S.C. 154(b) by 140 days.

(21) Appl. No.: 10/182,053

(22) PCT Filed: Dec. 5, 2001

(86) PCT No.: PCT/JP01/10630

§ 371 (c)(1),
(2), (4) Date: Jul. 25, 2002

(87) PCT Pub. No.: WO02/47060

PCT Pub. Date: Jun. 13, 2002

(65) Prior Publication Data

US 2003/0011548 A1 Jan. 16, 2003

(51) Int. Cl.[7] ..... G09G 3/36

(52) U.S. Cl. ..... 345/87; 345/88; 345/89; 345/90; 345/91; 345/92; 345/93; 345/98; 345/99; 345/100

(58) Field of Search ..... 345/87, 88, 89, 345/90, 91, 92, 93, 98, 99, 100

(56) References Cited

U.S. PATENT DOCUMENTS 6,384,806 B1 * 5/2002 Matsueda et al. ..... 345/89
6,549,186 B1 * 4/2003 Kwon ..... 345/95

FOREIGN PATENT DOCUMENTS

| | | |
|---|---|---|
| JP | 7-230077 | 8/1995 |
| JP | 9-90908 | 4/1997 |
| JP | 10-326084 | 12/1998 |
| JP | 2001-188499 | 7/2001 |
| JP | 2001-331153 | 11/2001 |
| JP | 2001-345928 | 12/2001 |

* cited by examiner

*Primary Examiner*—Richard Hjerpe
*Assistant Examiner*—Jean Lesperance
(74) *Attorney, Agent, or Firm*—Rader, Fishman & Grauer PLLC; Ronald P. Kananen

(57) ABSTRACT

In order to solve a subject that a polycrystalline silicon TFT liquid crystal display apparatus of the driving circuit integration type cannot adopt a technique for reducing the power consumption by an output section, according to the present invention, for example, a sampling latch circuit which composes a horizontal driving circuit (data line driving circuit) of an active matrix type display apparatus is configured such that, when a 1-bit mode (2-gradation mode) is set, a control signal A of the "H" level and another control signal B of the "L" level (low level) are outputted from a 1-bit mode control circuit (16) to place only AND circuits (31-2 and 32-2) corresponding to the most significant bit (MSB) into a passage permitting state to place only latch circuits (35-2 and 36-2) of the MSB into a data writing permitting state (active state) while the remaining latch circuits (35-0, 35-1, 36-0 and 36-1) are placed into a data writing inhibiting state (inactive state).

22 Claims, 9 Drawing Sheets

| Mode | A | B | MBS LATCHES | OTHER LATCHES |
|---|---|---|---|---|
| 3bit | High | High | ACTIVE (WRITABLE) | ACTIVE (WRITABLE) |
| 1bit | High | Low | ACTIVE (WRITABLE) | INACTIVE (NON-WRITABLE) |

| Mode | C | D | MBS LATCHES | OTHER LATCHES |
|---|---|---|---|---|
| 3bit | Pulse | Pulse | ACTIVE (WRITABLE) | ACTIVE (WRITABLE) |
| 1bit | Pulse | All Low | ACTIVE (WRITABLE) | COMPULSORY HIGH / INACTIVE (NON-WRITABLE) |

ACTIVE MATRIX DISPLAY DEVICE AND MOBILE TERMINAL USING THE DEVICE

TECHNICAL FIELD

This invention relates to an active matrix type display apparatus and a portable terminal using the same and, more particularly, to an active matrix type display apparatus wherein a polycrystalline silicon TFT (Thin Film Transistor) is used as a switching element of a pixel and a portable terminal wherein the active matrix type display apparatus is used as a display section.

BACKGROUND ART

In recent years, portable terminals, such as portable telephone sets and PDA (Personal Digital Assistants) have been popularized remarkably. One of the factors of such rapid popularization of portable terminals is considered to be the use of a liquid crystal display apparatus incorporated as an output display section of the portable terminals. This is because the liquid crystal display apparatus has a characteristic that power for driving the same is not required in principle, and it is a display device of low power consumption.

In such portable terminals, as described above, a demand for further reduction of power consumption of a display apparatus is increasing along with the rapid popularization of portable terminals. Reduction of the power consumption particularly within a standby period is a significant point for increasing the duration of a battery, and, therefore, this is one of the items for which demand is the highest. Various power saving techniques have been proposed to satisfy the demand. One such technique is the 1-bit mode (two-gradation mode) which restricts the number of gradations of a display of an image in a standby state to "2" (1 bit) for each color. According to the 1-bit mode, a gradation is represented with 1 bit for each color, and, therefore, an image is displayed using eight colors.

Incidentally, in a liquid crystal active matrix type display apparatus wherein an amorphous silicon TFT is used as a switching element of each of a large number of pixels arranged in a matrix manner, a number of analog circuits (buffer circuits) equal to the number of outputs are disposed in an output section of a data line driving circuit (horizontal driving circuit). Since a fixed bias current must always be supplied to the buffer circuits, the buffer circuits are a major factor in consuming such a high power.

The data line driving circuit of the amorphous silicon TFT liquid crystal display apparatus conventionally adopts a configuration that, in order to allow the same to deal with the 1-bit mode described above, a CMOS inverter is connected in parallel to each of the buffer circuits of the output section and is used in place of the buffer circuit when the gradation number is to be restricted to "2" as a result of setting the 1-bit mode. Since no DC current may be supplied to the CMOS inverter and, therefore, the DC current to the output section of the data line driving circuit can be reduced significantly, a reduction of the power consumption can be achieved.

Meanwhile, in recent years, in a liquid crystal active matrix type display apparatus wherein a polycrystalline silicon TFT is used as a switching element of a pixel, there is a tendency to form a digital interface driving circuit integrally on the same substrate as that of a display area section on which pixels are arranged in a matrix manner. In the polycrystalline silicon TFT liquid crystal display apparatus of the driving circuit integration type, a horizontal driving system and a vertical driving system disposed at peripheral portions (a frame) of the display area section and are formed integrally on the same substrate as that of the pixel area section using a polycrystalline silicon TFT.

However, in the polycrystalline silicon TFT liquid crystal display apparatus of the driving circuit integration type, no buffer is disposed in the output section, which is different from the amorphous silicon TFT liquid crystal display apparatus. Accordingly, the technique for reducing the power consumption by the output section cannot be adopted as in the case of the amorphous silicon TFT liquid crystal display apparatus, and, naturally, reduction of the power consumption by the 1-bit mode cannot be applied.

The present invention has been made in view of the subject described above, and it is an object of the present invention to provide an active matrix type display apparatus to which reduction of the power consumption by the 1-bit mode can be applied while it uses a polycrystalline silicon TFT structure of the driving circuit integration type, thereby to achieve a further reduction of the power consumption and a portable terminal wherein the active matrix type display apparatus is used as a display section.

DISCLOSURE OF INVENTION

In order to attain the object described above, according to the present invention, an active matrix type display apparatus which includes a display area section wherein pixels each having an electro-optical device are disposed in a matrix manner, a vertical driving circuit for selecting the pixels of the display area section in a unit of a row, and a horizontal driving circuit for receiving digital image data as an input thereto and supplying the digital image data as an analog image signal to the pixels of a row selected by the vertical driving circuit is configured such that, when a low gradation mode which uses a smaller number of gradations than a normal mode is set, only a number of circuit portions of the horizontal driving circuit equal to the number of gradations are placed into an active state.

In the active matrix type display apparatus having the configuration described above or the portable terminal which uses the active matrix type display apparatus, only a number of circuit portions equal to the number of gradations in the horizontal driving circuit are placed into an active state when the low gradation mode, wherein a smaller number of gradations than that in the normal mode are used, is set while the remaining circuit portions are placed into an inactive state and do not consume the power. Consequently, reduction of the power consumption can be anticipated as much.

BEST MODE FOR CARRYING OUT THE INVENTION

In the following, embodiments of the present invention are described in detail with reference to the drawings.

Figure 1:
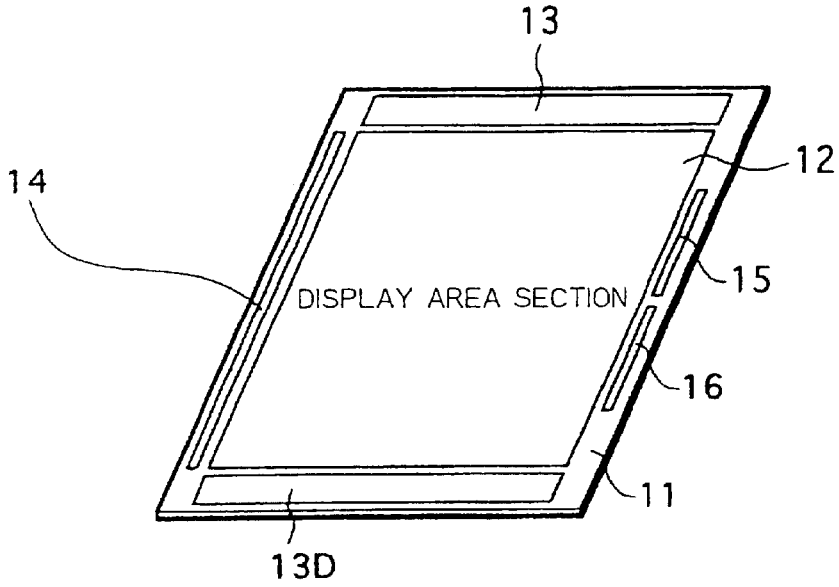
FIG. 1 is a view of a schematic configuration showing an example of a configuration of an active matrix type display apparatus according to an embodiment of the present invention.

FIG. 1 is a view of a schematic configuration showing an example of a configuration of a display apparatus according to the present invention. Here, the description is given taking, a case wherein the present invention is applied, for example, to a liquid crystal active matrix type display apparatus in which a liquid crystal cell is incorporated as an electro-optical element of each pixel.

Referring to FIG. 1, a display area section 12 wherein a large number of pixels each including a liquid crystal cell are disposed in a matrix manner, a pair of upper and lower H drivers (horizontal driving circuits) 13U and 13D and a V driver (vertical driving circuit) 14, as well as a reference voltage generation circuit 15 for generating a plurality of reference voltages and a 1-bit mode control circuit 16, are integrated on a transparent insulation substrate, for example, a glass substrate 11. The glass substrate 11 is formed from a first substrate wherein a large number of pixel circuits each including an active device (for example, a transistor) are disposed in a matrix manner and a second substrate disposed in an opposing relationship to the first substrate with a predetermined gap left therebetween. A liquid crystal material is enclosed in a space between the first and second substrates.

Figure 2:
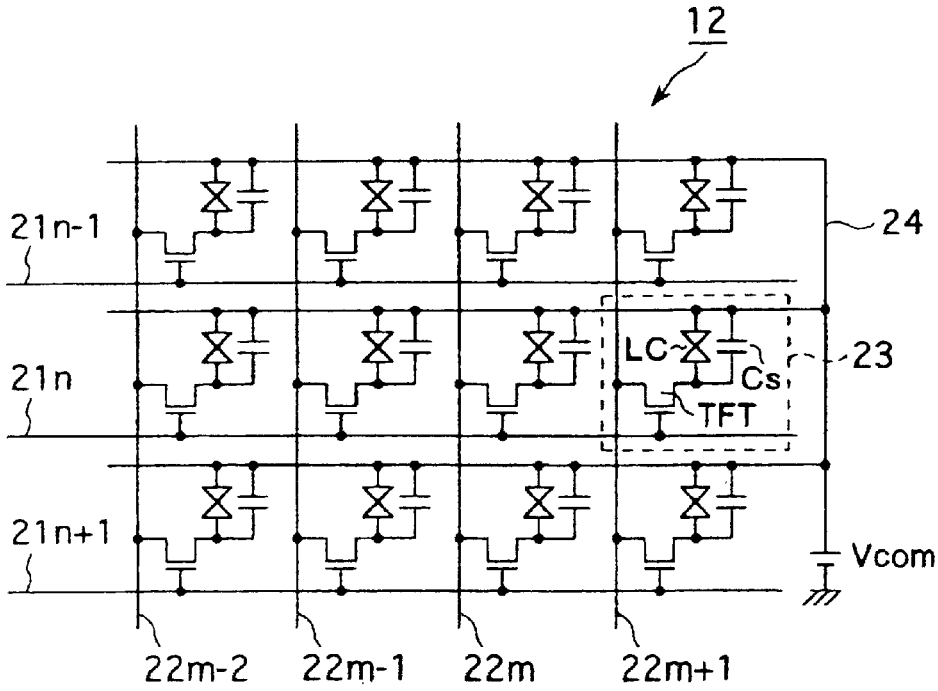
FIG. 2 is a circuit diagram showing an example of a configuration of a display area section of a liquid crystal display apparatus.

An example of a particular configuration of the display area section 12 is shown in FIG. 2. Here, in order to simplify the drawing, a pixel arrangement of three rows (n−1th row to n+1th row) and four columns (m−2th column to m+1th column) is shown as an example. In FIG. 2, vertical scanning lines . . . , 21$n$−1, 21$n$, 21$n$+1, . . . , and data lines . . . , 22$m$−2, 22$m$−1, 22$m$, 22$m$+1, . . . are wired in a matrix manner on the display area section 12, and a unit pixel 23 is disposed at each of intersection points of the vertical scanning lines and the data lines.

The unit pixel 23 includes a thin film transistor TFT, which is a pixel transistor, a liquid crystal cell LC and a storage capacitor Cs. Here, the liquid crystal cell LC signifies a capacitor that is produced between a pixel electrode (one electrode) formed from the thin film transistor TFT and a counter-electrode (the other electrode) formed in an opposing relationship to the pixel electrode.

The gate electrode of the thin film transistor TFT is connected to the vertical scanning lines . . . , 21$n$−1, 21$n$, 21$n$+1, . . . , and the source electrode of the thin film transistor TFT is connected to the data lines . . . , 22$m$−2, 22$m$−1, 22$m$, 22$m$+1, . . . The pixel electrode of the liquid crystal cell LC is connected to the drain electrode of the thin film transistor TFT and the counter-electrode of the liquid crystal cell LC is connected to a common line 24. The storage capacitor Cs is connected between the drain electrode of the thin film transistor TFT and the common line 24. A predetermined DC voltage is applied as a common voltage Vcom to the common line 24.

One terminal of each of the vertical scanning lines . . . , 21$n$−1, 21$n$, 21$n$+1, . . . is connected to an output terminal of the V driver 14 shown in FIG. 1 for a corresponding one of the rows. The V driver 14 is formed from, for example, a shift register and successively generates a vertical selection pulse in synchronism with a vertical transfer clock VCK (not shown) and applies it to the vertical scanning lines . . . , 21$n$−1, 21$n$, 21$n$+1, . . . to perform vertical scanning.

Meanwhile, in the display area section 12, for example, one terminal of each of the data lines of odd numbers . . . , 21$n$−1, 21$n$+1, . . . is connected to an output terminal of the H driver 13U shown in FIG. 1 for a corresponding one of the columns, and each of the other terminals of the data lines of even numbers . . . , 22$m$−2, 22$m$, . . . is connected to an output terminal of the H driver 13D shown in FIG. 1 for a corresponding one of the columns.

Figure 3:
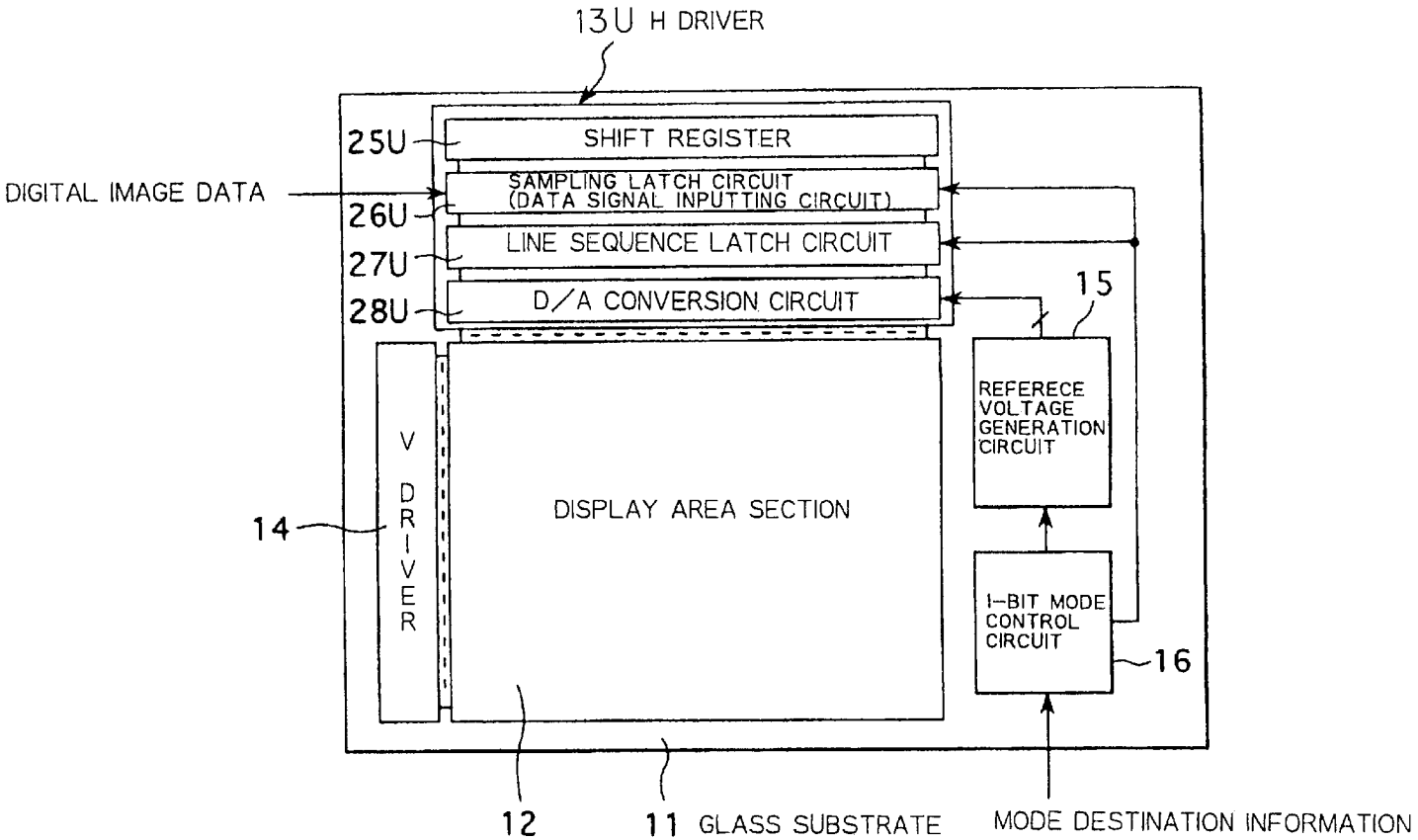
FIG. 3 is a block diagram particularly showing a mutual relationship among different components on a glass substrate.

FIG. 3 is a block diagram particularly showing a mutual relationship of different components on the glass substrate 11. Here, only the H driver 13U on the upper side is shown for simplification of the drawing. However, the H driver 13D on the lower side also has a quite similar configuration to that of the H driver 13U. It is to be noted that, while the liquid crystal active matrix type display apparatus according to the present example adopts the configuration wherein the H drivers 13U and 13D are disposed above on the upper and lower sides of the display area section 12, the configuration is not limited to this, and it is otherwise possible to adopt another configuration wherein the H drives 13U and 13D are disposed on only one of the upper and lower sides of the display area section 12.

As shown in FIG. 3, the H driver 13U includes a shift register 25U, a sampling latch circuit (data signal inputting circuit) 26U, a line sequence latch circuit 27U, and a D/A conversion circuit 28U. The shift resister 25U sequentially outputs a shift pulse from each transfer stage thereof in synchronism with a horizontal transfer clock HCK (not shown) to perform horizontal scanning. The sampling latch circuit 26U samples and latches, in point sequence, digital image data of predetermined bits inputted in response to the shift pulse supplied thereto from the shift register 25U to latch the digital image data.

The line sequence latch circuit 27U latches the digital image data latched in point sequence by the sampling latch circuit 26U in a unit of one line again to perform line sequence of the digital image data and outputs the digital image data for one line at a time. The D/A conversion circuit 28U has a configuration of, for example, a circuit of the reference voltage selection type, and it converts the digital image data for one line outputted from the line sequence latch circuit 27U into an analog image signal and supplies it to the data lines . . . , 22$m$−2, 22$m$−1, 22$m$, 22$m$+1, . . . of the pixel area section 12.

The reference voltage generation circuit 15 is a circuit attendant on the reference voltage selection type D/A conversion circuit 28U, and it generates a number of reference voltages equal to the number of gradations corresponding to the bit number of input image data and applies the reference voltages to the reference voltage selection type D/A conversion circuit 28U. The 1-bit mode control circuit 16 performs control of the horizontal driving system (H drivers 13U and 13D), including the reference voltage generation circuit 15, to render only a number of circuit portions equal to the number of gradations (in the present example, 2 gradations) into an active state when a low gradation mode which is one of the power saving modes, for example, a 2-gradation mode (1-bit mode), is designated.

It is to be noted that, while in the liquid crystal active matrix type display apparatus according to the present example, all of the components of the horizontal driving system, that is, the shift register 25U, the sampling latch circuit 26U, the line sequence latch circuit 27U and the D/A conversion circuit 28U shown in FIG. 3, are formed integrally on the same glass substrate 11 together with the display area section 12. Alternatively, only one of them may be formed integrally.

Where also the reference voltage generation circuit 15 and the 1-bit mode control circuit 16 are formed integrally on the same glass substrate 11 together with the display area section 12, for example, in the case of a liquid crystal active matrix type display apparatus which adopts the configuration wherein the H drivers 13U and 13D are disposed on the upper and lower sides of the display area section 12, preferably the reference voltage generation circuit 15 and the 1-bit mode control circuit 16 are disposed in a frame area (peripheral area of the display area section 12) on a side or sides on which the H drivers 13U and 13D are not incorporated.

The reason is that, since the H drivers 13U and 13D include a great number of components when compared with the V driver 14, as described above, and in most cases have a very great circuit area, where they are disposed in the frame area on a side or sides on which the H drivers 13U and 13D are not disposed, the reference voltage generation circuit 15 and the 1-bit mode control circuit 16 can be integrated on the same glass substrate 11 as that of the display area section 12 without deteriorating the effective screen ratio (the area ratio of the display area section 12 to the glass substrate 11).

It is to be noted that the liquid crystal active matrix type display apparatus according to the present example adopts the configuration wherein, since the V driver 14 is mounted on one side of the frame area on one of the two sides on which the H drivers 13U and 13D are not disposed, the reference voltage generation circuit 15 and the 1-bit mode control circuit 16 are integrated in the frame area on another side on which the H drivers 13U and 13D are not disposed.

Further, upon such integration of the H drivers 13U and 13D, V driver 14, reference voltage generation circuit 15 and 1-bit mode control circuit 16, since a polycrystalline silicon thin film transistor TFT is used for the pixel transistors of the display area section 12, if a polycrystalline silicon thin film transistor is used also for the transistors which form the components mentioned and at least the transistor circuits of the same are produced on the same glass substrate 11 together with the display area section 12, then they can be produced readily and, besides, implemented at a low cost.

With regard to the thin film transistor TFT, as things stand, integration has become easy thanks to the augmentation in performance and the reduction of power consumption in recent years. Accordingly, where the H drivers 13U and 13D, V driver 14, reference voltage generation circuit 15 and 1-bit mode control circuit 16, particularly, at least the transistor circuits of components of them, are formed integrally on the same glass substrate 11 by the same process using a thin film transistor the same as that used for the pixel transistors of the display area section 12, reduction of the cost by simplification of the production process and, besides, a reduction in thickness and a compaction by integration can be achieved.

In the following, particular examples of a configuration and an operation of the components of the horizontal driving system are described. It is to be noted that, in each example of a configuration, a case wherein digital image data is 3-bit data is taken as an example, and, for simplification of the drawings, a configuration of only circuit portions corresponding to transfer stages 25Uk and 25Uk+1 of the kth and k+1th stages of the shift register 25U is shown and described.

Figure 4:
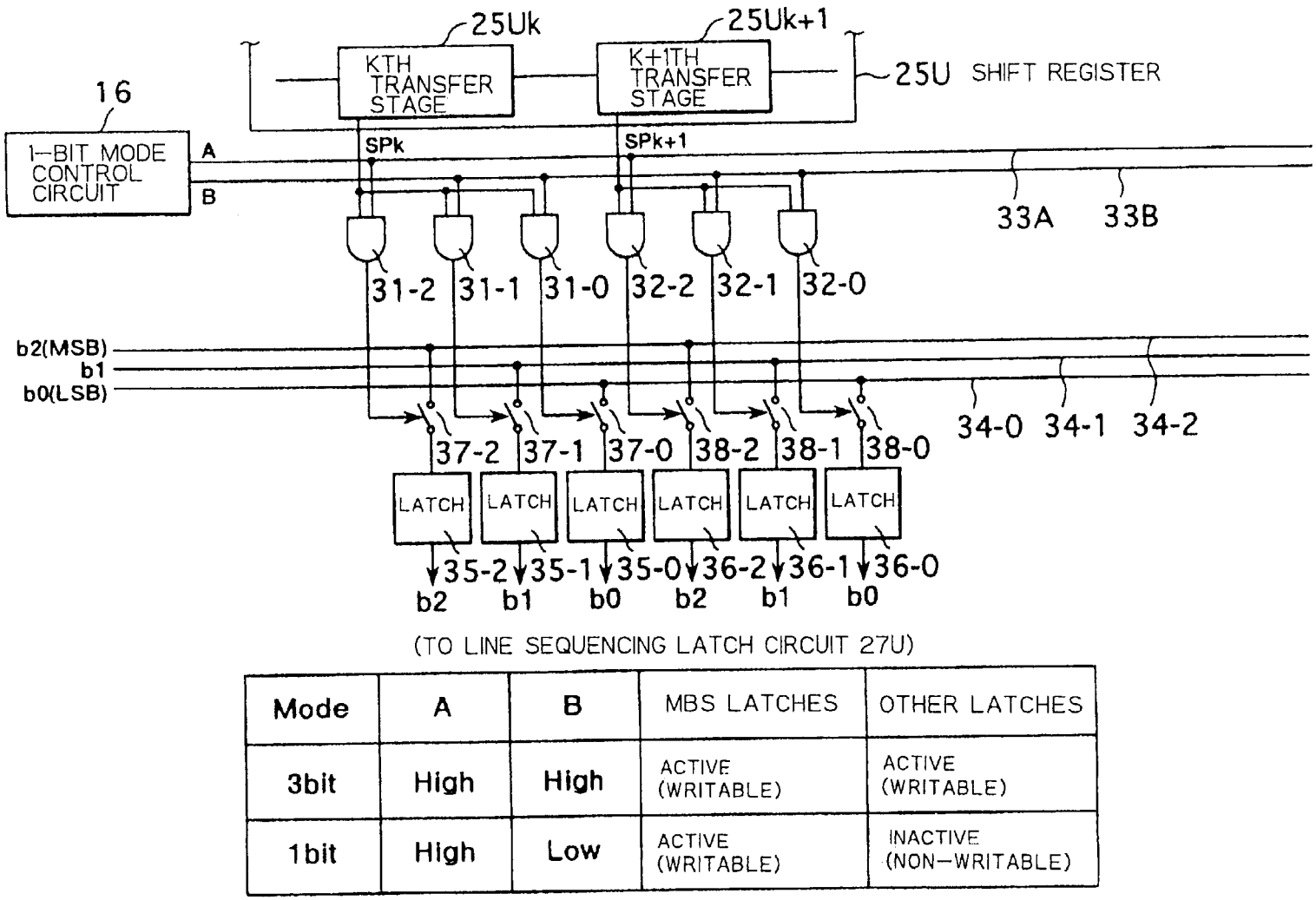
FIG. 4 is a block diagram showing an example of a particular configuration of a sampling latch circuit.

FIG. 4 is a block diagram showing a particular example of a configuration of the sampling latch circuit 26U. Referring to FIG. 4, three AND circuits 31-0, 31-1 and 31-2 are provided corresponding to the transfer stage 25Uk of the kth stage of the shift register 25U, and three AND circuits 32-0, 32-1 and 32-2 are provided corresponding to the transfer stage 25Uk+1 of the k+1th stage of the shift register 25U. The number of the AND circuits is a number corresponding to the bit number "3" of the digital image data.

Shift pulses of the transfer stages 25Uk and 25Uk+1 of the shift register 25U are applied as sampling pulses SPk and SPk+1 to input terminals of the AND circuits 31-0, 31-1, 31-2, 32-0, 32-1 and 32-2 on one side. A control signal A is applied to the other input terminals of the AND circuits 31-2 and 32-2 from the 1-bit mode control circuit 16 over a control line 33A. Meanwhile, a control signal B is applied to the other input terminals of the AND circuits 31-0, 31-1, 32-0 and 32-1 from the 1-bit mode control circuit 16 over a control line 33B.

To the present sampling latch circuit 26U, digital image data of, for example, 3 bits is inputted over bit lines 34-0, 34-1 and 34-2. Latch circuits 35-0, 35-1 and 35-2 and latch circuits 36-0, 36-1 and 36-2 are provided for latching the digital image data of 3 bits in response to the sampling pulses SPk and SPk+1 outputted successively from the transfer stages 25Uk and 25Uk+1 of the shift register 25U.

Switches 37-0, 37-1 and 37-2 are connected between the input terminals of the latch circuits 35-0, 35-1 and 35-2 and the bit lines 34-0, 34-1 and 34-2, and switches 38-0, 38-1 and 38-2 are connected between the input terminals of the latch circuits 36-0, 36-1 and 36-2 and the bit lines 34-0, 34-1 and 34-2. The switches 37-0, 37-1, 37-2, 38-0, 38-1 and 38-2 are controlled between on (close)/off (open) with outputs of the AND circuits 31-0, 31-1, 31-2, 32-0, 32-1 and 32-2, respectively.

Subsequently, the circuit operation of the sampling latch circuit 26U having the above-described configuration is described.

First, in a normal mode (3-bit mode), the control signals A and B, both having the "H" level (high level), are outputted from the 1-bit mode control circuit 16. Consequently, the sampling pulses SPk and SPk+1 successively outputted from the transfer stages 25Uk and 25Uk+1 of the shift register 25U are supplied to all the switches 37-0, 37-1, 37-2, 38-0, 38-1 and 38-2 through the AND circuits 31-0 to 31-2 and 32-0 to 32-2, respectively. As a result, all the latch circuits 35-0 to 35-2 and 36-0 to 36-2 are placed into an active state, that is, into a state wherein data can be written into (latched by) them.

On the other hand, when the 1-bit mode is set, the control signal A of the "H" level and the control signal B of the "L" level (low level) are outputted from the 1 bit mode control circuit 16. Consequently, since only the AND circuits 31-2 and 32-2 corresponding to the most significant bit (MSB) are placed into a passage permitting state, the sampling pulses SPk and SPk+1 successively outputted from the transfer stages 25Uk and 25Uk+1 of the shift register 25U are supplied only to the switches 37-2 and 38-2 through the AND circuits 31-2 and 32-2, respectively.

As a result, only the latch circuits 35-2 and 36-2 are placed into a data rewriter permitting state (active state) while the latch circuits 35-0, 35-1, 36-0 and 36-1 are placed into a data write inhibiting state (inactive state). Consequently, when the 1-bit mode is set, the writable current upon the latching rewriting operation decreases, and as a result, a relative reduction of the power consumption can be anticipated.

Figure 5:
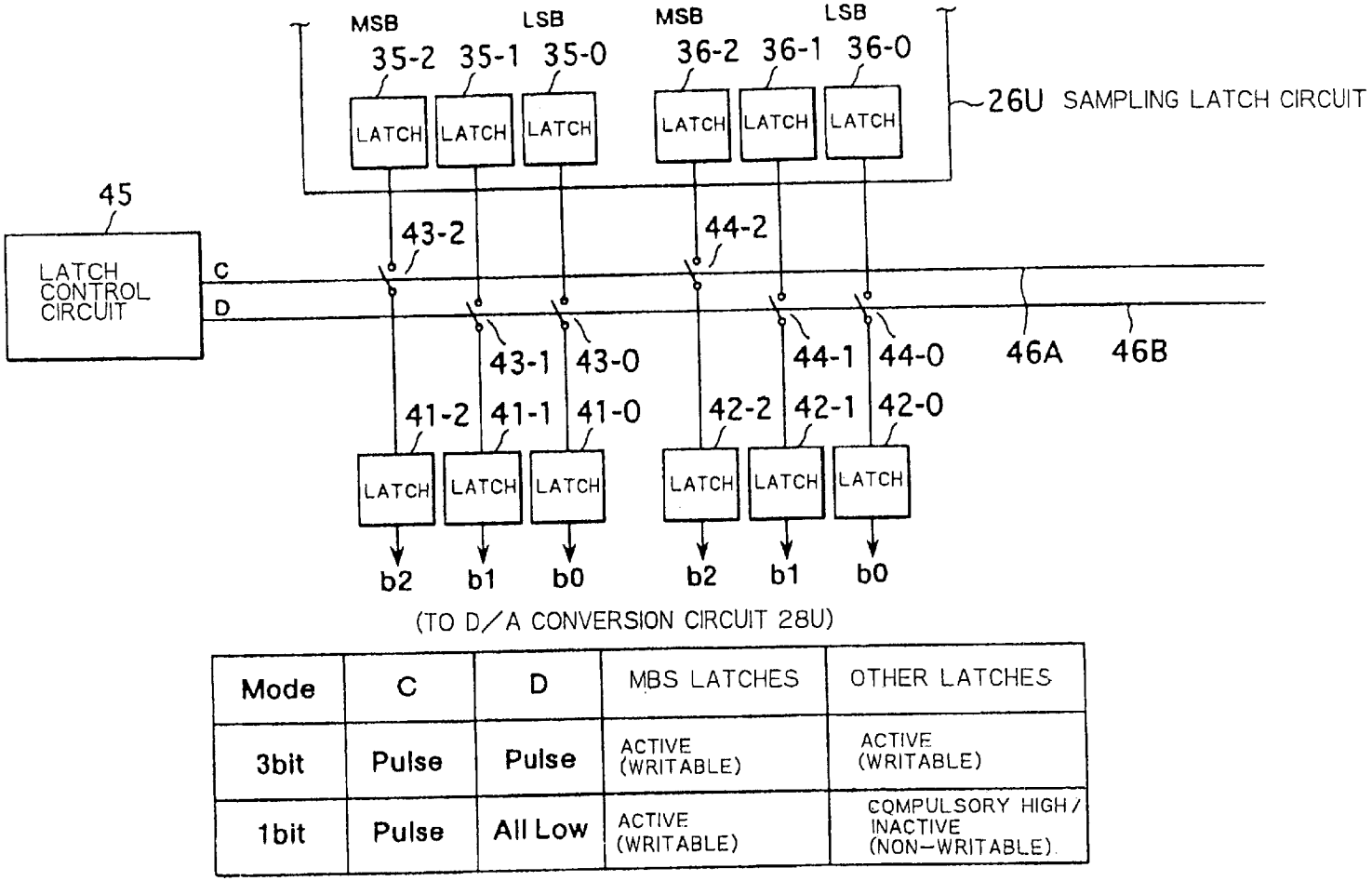
FIG. 5 is a block diagram showing an example of a particular configuration of a line sequence latch circuit.

FIG. 5 is a block diagram showing a particular example of a configuration of the line-sequence latch circuit 27U. Referring to FIG. 5, latch circuits 41-0, 41-1, 41-2, 42-0, 42-1 and 42-2 are provided corresponding to the latch circuit 35-0, 35-1, 35-2, 36-0, 36-1 and 36-2 of the sampling latch circuit 26U, respectively, and switches 43-0, 43-1, 43-2, 44-0, 44-1 and 44-2 are connected between the input and output terminals of them, respectively.

Of the switches mentioned, the switches 43-2 and 44-2 of the MSB are controlled between on/off with a latch control pulse C generated by a latch control circuit 45 and supplied thereto over a control line 46A. The other latches 43-0, 43-1, 44-0 and 44-1 are controlled between on/off with a latch control pulse D generated by the latch control circuit 45 and supplied thereto over a control line 46B.

Subsequently, the circuit operation of the line sequence latch circuit 27U of the above-described configuration is described.

First, in the normal mode (3-bit mode), both of the latch control pulses C and D are outputted from the latch control circuit 45. Consequently, all of the switches 43-0 to 43-2 and 44-0 to 44-2 are permitted to be switched on/off in response to the latch control pulses C and D, and all of the latch circuits 41-0 to 41-2 and 42-0 to 42-2 are placed into an active state, that is, in a state wherein data can be written into (latched to) them.

On the other hand, when the 1-bit mode is set, the latch control pulse C is outputted from the latch control circuit 45 while the latch control pulse D is fixed to the "L" level. Consequently, only the switches 43-2 and 44-2 are permitted to be switched on/off in response to the latch control pulse C, and only the latch circuits 41-2 and 42-2 of the MSB are placed into a state (active state) wherein rewriting of data is permitted while the remaining latch circuits 41-0, 41-1, 42-0 and 42-1 are placed into another state (inactive state) wherein rewriting of data is inhibited.

As a result, when the 1-bit mode is set, writing current upon latch rewriting becomes low, and, therefore, the power consumption can be reduced as much. It is to be noted that, if in addition to the circuit operation described above, the values of the latch circuits 41-0, 41-1, 42-0 and 42-1 for the others than the MSB are compulsorily set to the logic "0" or the logic "1" immediately before the writing inhibition state is established, then a system which matches with circuit operation of the D/A conversion circuit 28U that is hereinafter described can be implemented.

Figure 6:
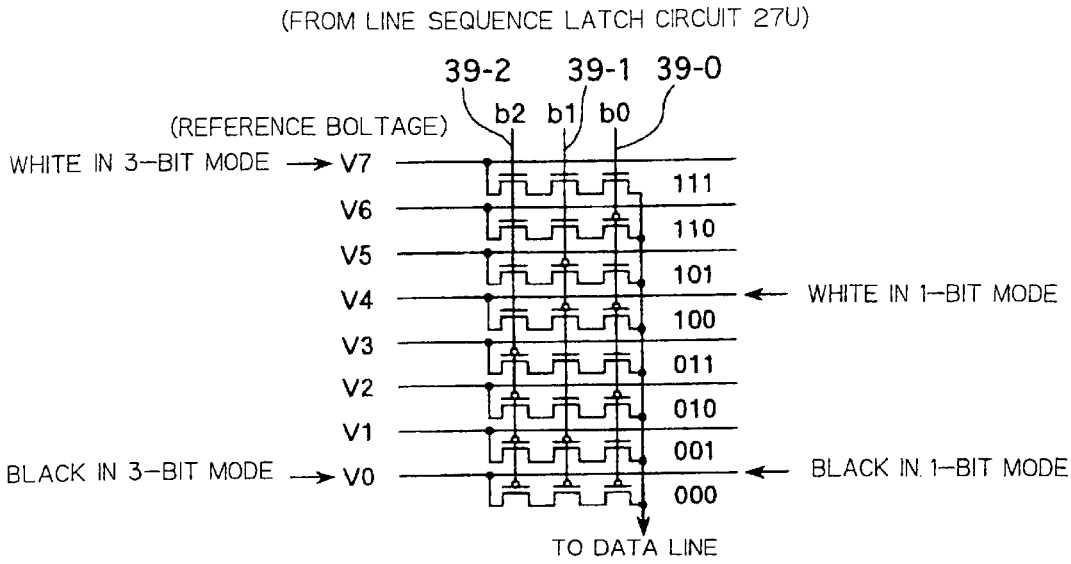
FIG. 6 is a circuit diagram showing an example of a configuration of a unit circuit of a reference voltage selection type D/A conversion circuit.

FIG. 6 is a circuit diagram showing an example of a configuration of a unit circuit of the reference voltage selection type D/A conversion circuit 28U. Here, 8 ($=2^3$) reference voltages V0 to V7 are prepared for 3-bit (b0, b1, b2), digital image data. One such unit circuit is disposed for each of the data lines . . . , 22*m*-2, 22*m*-1, 22*m*, 22*m*+1, . . . of the display area section 12.

The reference voltage selection type D/A conversion circuit 28U of the configuration described above performs, in the normal mode (3-bit mode), an operation such that a black level is applied as the reference voltage V0 while a white level is applied as the reference voltage V7 and one of the reference voltages V0 to V7 is selected based on 3-bit (b0, b1, b2) data.

On the other hand, in the 1-bit mode, for example, a black level is applied as the reference voltage V0 while a white level is applied as the reference voltage V4, and of input control lines 39-0, 39-1 and 39-2, only the input control line 39-2 of the MSB is used, and a reference voltage is selected only with data of the MSB (b2) to represent the white or the black. At this time, the potentials to the input control lines 39-0 and 39-1 of the LSB side are fixed compulsorily to the logic "0".

In this manner, since, in the 1-bit mode only the input control line 39-2 of the MSB is used to perform selection of a reference voltage in a state wherein the potentials to the input control lines 39-0 and 39-1 are fixed compulsorily to the logic "0", charging or discharging current of large capacity loads to the input control lines 39-0, 39-1 and 39-2 can be saved with regard to the input control lines 39-0 and 39-1, and, consequently, reduction of the power consumption can be achieved.

It is to be noted that, while it is described here that the input control line 39-2 of the most significant bit (MSB) is used, use of an input control line is not limited to this, and it is otherwise possible to use any one of the input control lines, and the potentials at the remaining input control lines should be fixed to the logic "0" or the logic "1" in response to the thus used input control line.

Figure 7:
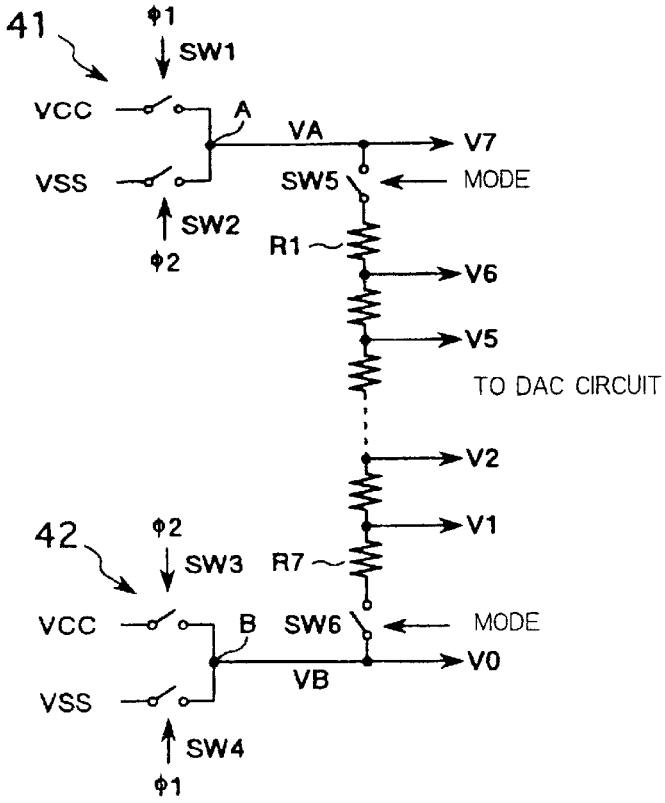
FIG. 7 is a circuit diagram showing an example of a configuration of a reference voltage generation circuit.

FIG. 7 is a circuit diagram showing an example of a configuration of the reference voltage generation circuit 15. Here, a description is given taking a case wherein eight reference voltages V0 to V7 are generated corresponding to 3-bit digital image data as an example.

The reference voltage generation circuit 15 according to the present configuration example includes a switch circuit 41, including switches SW1 and SW2, another switch circuit 42, including switches SW3 and SW4 which switch a positive power supply voltage VCC and a negative power supply voltage VSS in a fixed period in the opposite phases to each other, and seven dividing resistors R1 to R7 connected in series between output terminals A and B of the switch circuits 41 and 42 with switches SW5 and SW6 interposed therebetween, respectively. Here, the reason why the positive power supply voltage VCC and the negative power supply voltage VSS are switched with the opposite phases to each other in a fixed period, for example, in a 1H (H is a horizontal scanning interval) period, is that it is intended to AC drive the liquid crystal in order to prevent deterioration of the liquid crystal.

Figure 8:
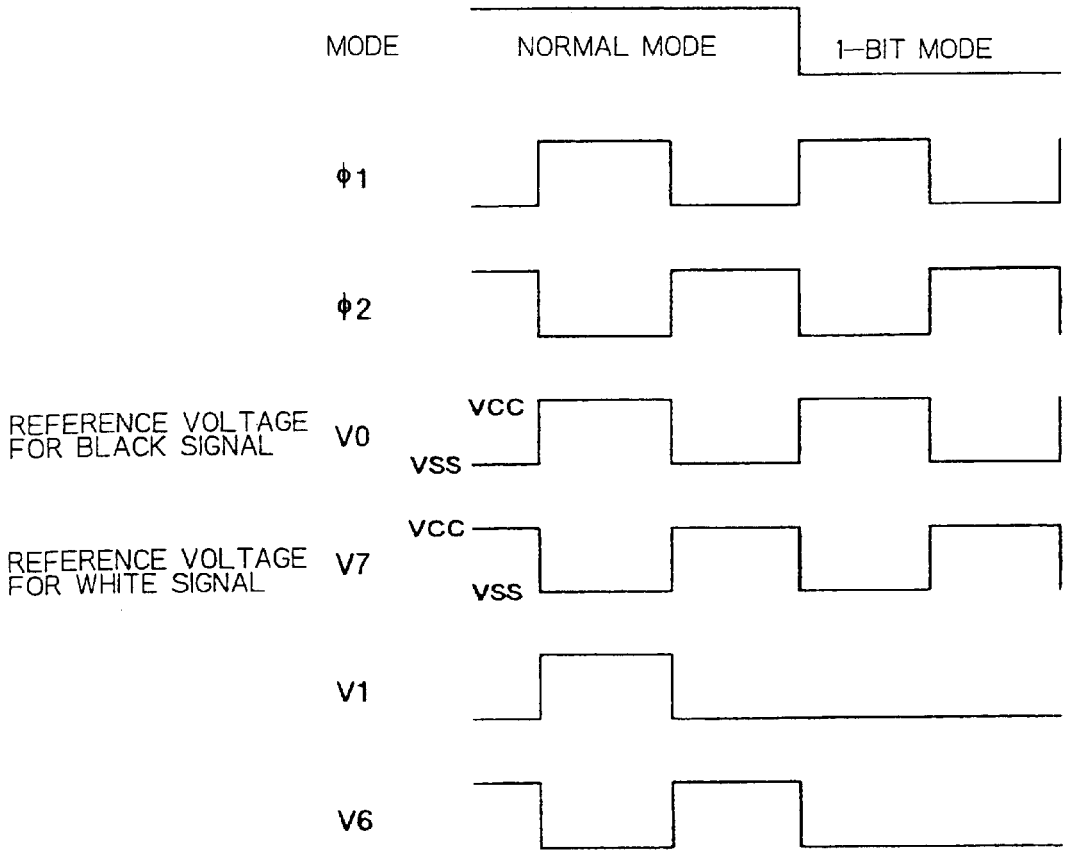
FIG. 8 is a timing chart illustrating the operation of the reference voltage generation circuit according to the example of the configuration.

In the reference voltage generation circuit 15 having the configuration described above, the reference voltage V0 for a black signal and the reference voltage V7 for a white signal are both produced by switching the positive power supply voltage VCC and the negative power supply voltage VSS in a fixed period based on control pulses $\phi 1$ and $\phi 2$ by the switch circuits 41 and 42, as shown in a timing chart of FIG. 8. Meanwhile, the reference voltages V1 to V6 for the intermediate gradations are produced by resistance division by the dividing resistors R1 to R7 of the reference voltage V0 for a block signal and the reference voltage V7 for a white signal.

On the other hand, in the 1-bit mode, the switches SW5 and SW6 are opened (switched off) to stop the supply of current to the dividing resistors R1 to R7. As a result, since no current flows to the dividing resistors R1 to R7 any more and power consumption by the dividing resistors R1 to R7 is eliminated, a reduction of the power consumption can be anticipated.

Figure 9:
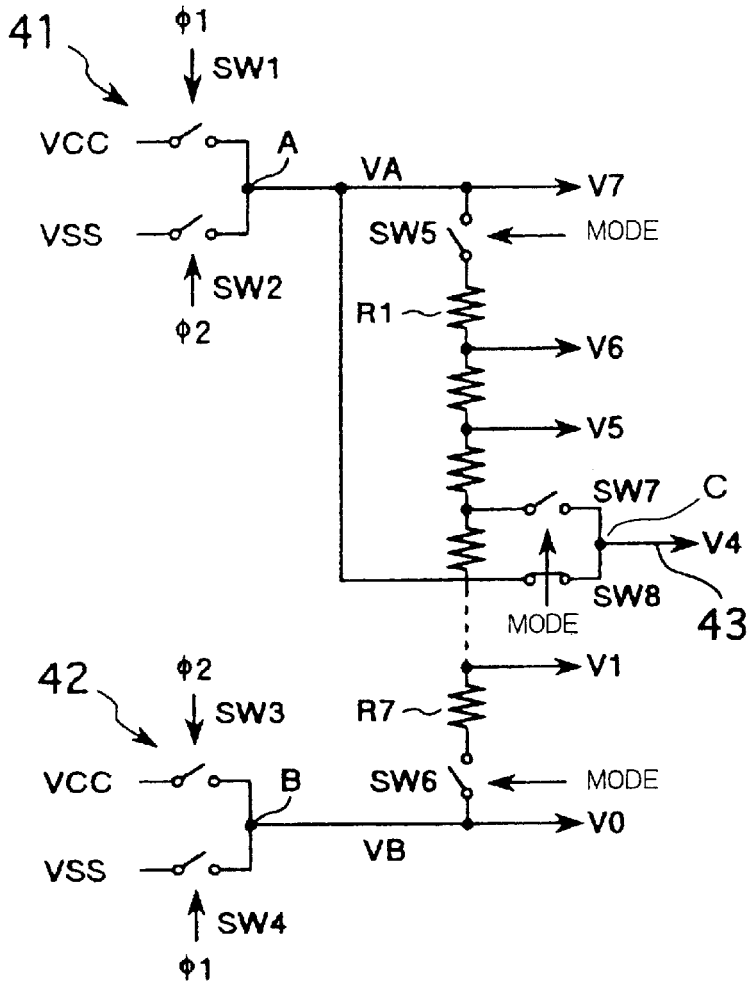
FIG. 9 is a circuit diagram showing another example of the configuration of the reference voltage generation circuit.

FIG. 9 is a circuit diagram showing another example of a configuration of the reference voltage generation circuit 15. In FIG. 9, like portions to those of FIG. 7 are denoted by like reference characters. It is to be noted that the reference voltage generation circuit 15 according to the present configuration example corresponds to the reference voltage selection type D/A conversion circuit of FIG. 6.

The reference voltage generation circuit 15 according to the present configuration example is configured such that, in order to make it correspond to the reference voltage selection type D/A conversion circuit of FIG. 6, switches SW7 and SW8 are connected between a voltage line 43, which provides the reference voltage V4, and an output terminal A of the switch circuit 41 and a voltage dividing point C of the reference voltage V4, respectively, and are controlled between on/off based on a mode signal of the 1-bit mode.

Figure 10:
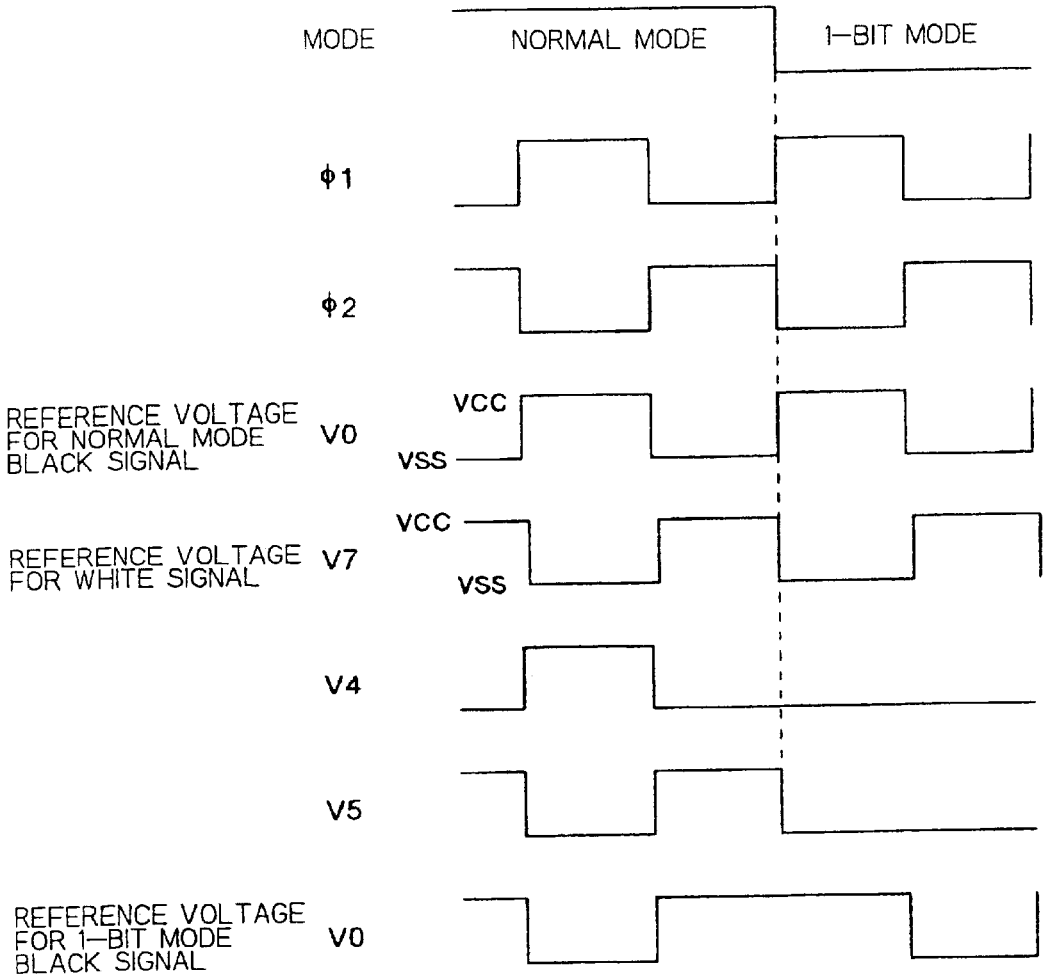
FIG. 10 is a timing chart illustrating the operation of the reference voltage generation circuit according to another example of the configuration.

Here, the switch SW7 is a switch that is placed into an on (closed) state in the normal mode (3-bit mode), and the switch SW8 is a switch that is placed into an on state in the 1-bit mode. Consequently, in the 1-bit mode, as apparent from the timing chart of FIG. 10, the switches SW5 and SW6 are placed into an off state so that current does not flow to the dividing resistors R1 to R7 for producing the reference voltages V1 to V6 of the intermediate gradations, and, simultaneously, the reference voltage V7 for a white signal is outputted to the voltage line 43 which provides the reference voltage V4 similarly as in the case of the preceding configuration example.

As a result, since in the 1-bit mode power consumption by the dividing resistors R1 to R7 disappears, reduction of the power consumption can be anticipated, and the reference voltage selection type D/A conversion circuit 28U can select the reference voltage for white/black using only one input control line as described hereinabove.

It is to be noted that, while in the embodiment described above, a description is given taking a case wherein the present invention is applied to a liquid crystal active matrix type display apparatus as an example, the present invention is not limited to this example alone, and can also be applied similarly to other active matrix type display apparatuses, such as an EL display apparatus wherein an electroluminescence (EL) element is used as an electro-optical element of each pixel.

Further, while, in the embodiment described above, a description is given taking the 1-bit mode (2-gradation mode) as an example of a low gradation mode which is one of the power saving modes, the applicable mode is not limited to this, and use of any gradation mode which uses a smaller number of gradations than the normal mode can achieve a corresponding reduction of the power consumption.

Furthermore, the active matrix type display apparatus according to the embodiment described above is applied as a display unit for OA equipment, such as a personal computer, a word processor, television receiver or the like, and is used suitably as an output display section for a portable terminal, such as a portable telephone set or a PDA, for which miniaturization and compaction of an apparatus body are needed.

Figure 11:
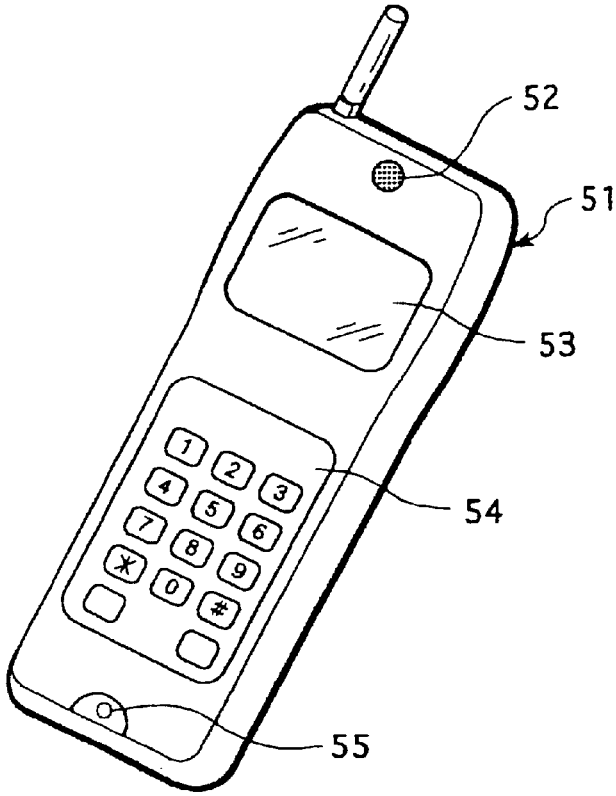
FIG. 11 is a view of an appearance showing a general configuration of a portable telephone set, which is a portable terminal according to the present invention.

FIG. 11 is a view of an appearance showing an outline of a configuration of a portable terminal, for example, a portable telephone set, to which the present invention is applied.

The portable telephone set according to the present example is configured such that a speaker section 52, a display section 53, an operation section 54 and a microphone section 55 are disposed in order from the upper side on a front face side of an apparatus housing 51. In the portable telephone set having such a configuration as just described, for example, a liquid crystal display apparatus is used for the display section 53, and, as this liquid crystal display apparatus, a liquid crystal active matrix type display apparatus according to the embodiment described above is used.

In this manner, since in a portable terminal, such as a portable telephone set, the liquid crystal active matrix type display apparatus described is used as the display section 53, the power consumption of the circuits incorporated in the liquid crystal display apparatus can be reduced with certainty when the liquid crystal display apparatus is in the 1-bit mode, which is one of the power saving modes. Consequently, a reduction of the power consumption of the display apparatus can be anticipated, and, therefore, the power consumption of the terminal body can be reduced.

As described above, according to the present invention, in an active matrix type display apparatus or a portable terminal which uses the active matrix type display apparatus as a display section thereof, only a number of circuit portions equal to the number of gradations in a horizontal driving circuit are placed into an active state when a low gradation mode wherein a smaller number of gradations than that in a normal mode are used is set while the remaining circuit portions are placed into an inactive state and do not consume the power. Consequently, relative reduction of the power consumption can be anticipated.

What is claimed is:

1. An active matrix type display apparatus, characterized in that it comprises:

a display area section wherein pixels each having an electro-optical device are disposed in a matrix manner;

a vertical driving circuit for selecting the pixels of said display area section in a unit of a row;

a horizontal driving circuit for receiving digital image data as an input thereto and supplying the digital image data as an analog image signal to the pixels of a row selected by said vertical driving circuit; and a control circuit for selectively assuming a low gradation mode which uses a smaller number of gradations than a normal mode and placing only a number of circuit portions of said horizontal driving circuit equal to the number of gradations into an active state when the low gradation mode is set.

2. An active matrix type display apparatus as set forth in claim 1, characterized in that said horizontal driving circuit includes a sampling latch circuit for successively sampling and latching the digital image data, a line sequence latch circuit for line sequence the latch data of said sampling latch circuit, and a D/A conversion circuit for converting the digital image data line sequenced by said line sequence latch circuit into an analog image signal.

3. An active matrix type display apparatus as set forth in claim 2, characterized in that, when the low gradation mode is set, said control circuit permits rewriting of data only in a number of circuit portions of said sampling latch circuit equal to the number of gradations but inhibits rewriting of data in the remaining circuit portions.

4. An active matrix type display apparatus as set forth in claim 2, characterized in that, when the low gradation mode is set, said control circuit permits rewriting of data only in a number of circuit portions of said line sequence latch circuit equal to the number of gradations but inhibits rewriting of data in the remaining circuit portions.

5. An active matrix type display apparatus as set forth in claim 2, characterized in that, when the low gradation mode is set, said control circuits uses only a number of input control lines equal to the number of gradations from among input control lines of said D/A conversion circuit and fixes the potentials at the remaining input control lines to the logic "0" or the logic "1".

6. An active matrix type display apparatus as set forth in claim 5, characterized in that said D/A conversion circuit is a reference voltage selection type D/A conversion circuit and the low gradation mode is an n-gradation mode wherein a display is given in n gradations, and said control circuit replaces n reference voltages, which can be selected when the n-gradation mode is set, into corresponding reference voltages.

7. An active matrix type display apparatus as set forth in claim 5, characterized in that said D/A conversion circuit is a reference voltage selection type D/A conversion circuit and includes a reference voltage generation circuit for generating a plurality of reference voltages by resistance division, and, when the low gradation mode is set, said control circuit stops supply of current to the dividing resistors of said reference voltage generation circuit.

8. An active matrix type display apparatus as set forth in claim 2, characterized in that at least one of said sampling latch circuit, said line sequence latch circuit and said D/A conversion circuit is formed integrally on the same substrate together with said display area.

9. An active matrix type display apparatus as set forth in claim 8, characterized in that an active element of each of the pixels of said display area section for driving said electro-optical element is formed from a thin film transistor, and at least one of said sampling latch circuit, said line sequence latch circuit and said D/A conversion circuit is formed using a thin film transistor.

10. An active matrix type display apparatus as set forth in claim 1, characterized in that said electro-optical element is a liquid crystal cell.

11. An active matrix type display apparatus as set forth in claim 1, characterized in that said electro-optical element is an electroluminescence element.

12. A portable terminal, characterized by using, as a display section thereof, an active matrix type display apparatus which includes:

- a display area section wherein pixels each having an electro-optical device are disposed in a matrix manner;
- a vertical driving circuit for selecting the pixels of said display area section in a unit of a row;
- a horizontal driving circuit for receiving digital image data as an input thereto and supplying the digital image data as an analog image signal to the pixels of a row selected by said vertical driving circuit; and
- a control circuit for selectively assuming a low gradation mode which uses a smaller number of gradations than a normal mode and placing only a number of circuit portions of said horizontal driving circuit equal to the number of gradations into an active state when the low gradation mode is set.

13. A portable terminal as set forth in claim 12, characterized in that said horizontal driving circuit includes a sampling latch circuit for successively sampling and latching the digital image data, a line sequence latch circuit for line sequence the latch data of said sampling latch circuit, and a D/A conversion circuit for converting the digital image data line sequenced by said line sequence latch circuit into an analog image signal.

14. A portable terminal as set forth in claim 13, characterized in that, when the low gradation mode is set, said control circuit permits rewriting of data only in a number of circuit portions of said sampling latch circuit equal to the number of gradations but inhibits rewriting of data in the remaining circuit portions.

15. A portable terminal as set forth in claim 13, characterized in that, when the low gradation mode is set, said control circuit permits rewriting of data only in a number of circuit portions of said line sequence latch circuit equal to the number of gradations but inhibits rewriting of data in the remaining circuit portions.

16. A portable terminal as set forth in claim 13, characterized in that, when the low gradation mode is set, said control circuits uses only a number of input control lines equal to the number of gradations from among input control lines of said D/A conversion circuit and fixes the potentials at the remaining input control lines to the logic "0" or the logic "1".

17. A portable terminal as set forth in claim 16, characterized in that said D/A conversion circuit is a reference voltage selection type D/A conversion circuit and the low gradation mode is an n-gradation mode wherein a display is given in n gradations, and said control circuit replaces n reference voltages, which can be selected when the n-gradation mode is set, into corresponding reference voltages.

18. A portable terminal as set forth in claim 16, characterized in that said D/A conversion circuit is a reference voltage selection type D/A conversion circuit and includes a reference voltage generation circuit for generating a plurality of reference voltages by resistance division, and, when the low gradation mode is set, said control circuit stops supply of current to the dividing resistors of said reference voltage generation circuit.

19. A portable terminal as set forth in claim 13, characterized in that at least one of said sampling latch circuit, said line sequence latch circuit and said D/A conversion circuit is formed integrally on the same substrate together with said display area.

20. A portable terminal as set forth in claim 19, characterized in that an active element of each of the pixels of said display area section for driving said electro-optical element is formed from a thin film transistor, and at least one of said sampling latch circuit, said line sequence latch circuit and said D/A conversion circuit is formed using a thin film transistor.

21. A portable terminal as set forth in claim 12, characterized in that said active matrix type display apparatus is a liquid crystal display apparatus which uses a liquid crystal cell as said electro-optical element.

22. A portable terminal as set forth in claim 12, characterized in that said active matrix type display apparatus is a liquid crystal display apparatus which uses an electroluminescence element as said electro-optical element.

* * * * *

UNITED STATES PATENT AND TRADEMARK OFFICE

CERTIFICATE OF CORRECTION

PATENT NO. : 6,839,043 B2
DATED : January 4, 2005
INVENTOR(S) : Yoshiharu Nakajima It is certified that error appears in the above-identified patent and that said Letters Patent is hereby corrected as shown below:

Title page,
Item [54], Title, should read
-- ACTIVE MATRIX TYPE DISPLAY APPARATUS AND PORTABLE TERMINAL USING THE SAME --.
Item [57], ABSTRACT,
Line 1, "subject that" should read -- problem wherein --.
Line 5, "for example" should be deleted and "circuit" should read -- circuit, --.

Column 10,
Lines 8, 10 and 13, "claim 1" should read -- claim 12 --.
Line 56, "sequence" should read -- sequencing --.
Lines 61 and 67, "low gradation" should read -- low-gradation --.
Line 64, "but" should read -- and --.

Column 11,
Line 3, "but" should read -- and --.
Line 26, "stop supply" should read -- stops a supply --.

Column 12,
Line 3, "sequence" should read -- sequencing --.
Lines 11 and 17, "but" should read -- and --.
Line 39, "stops" should read -- stops a --.

Signed and Sealed this

Eleventh Day of October, 2005

JON W. DUDAS
*Director of the United States Patent and Trademark Office*

UNITED STATES PATENT AND TRADEMARK OFFICE

CERTIFICATE OF CORRECTION

PATENT NO. : 6,839,043 B2
APPLICATION NO. : 10/182053
DATED : January 4, 2005
INVENTOR(S) : Yoshiharu Nakajima It is certified that error appears in the above-identified patent and that said Letters Patent is hereby corrected as shown below:

The foreign application priority data should read:
--(30) Foreign Application Priority Data
Dec. 7, 2000 (JP).....2000-371046 --.

Signed and Sealed this

Thirty-first Day of July, 2007

JON W. DUDAS
*Director of the United States Patent and Trademark Office*